US005309854A

United States Patent [19]

Mulcahey et al.

[11] Patent Number: 5,309,854

[45] Date of Patent: May 10, 1994

[54] HIGH LIFT SEWING MACHINE

[75] Inventors: Charles E. Mulcahey, Beverly; John J. Kirby, South Hamilton; Michael R. Porter, Topsfield, all of Mass.

[73] Assignee: Porter Sewing Machines, Inc., Beverly, Mass.

[21] Appl. No.: 854,373

[22] Filed: Aug. 19, 1992

[51] Int. Cl.[5] ..... D05B 27/04

[52] U.S. Cl. ..... 112/314; 112/320; 112/313

[58] Field of Search ..... 112/320, 312, 313, 303, 112/311, 314, 323, 324

[56] References Cited

U.S. PATENT DOCUMENTS

| | | | |
|---|---|---|---|
| Re. 24,005 | 11/1951 | Knaus | 112/209 |
| 722,014 | 3/1903 | Harmon . | |
| 1,006,827 | 10/1911 | Chauvet et al. . | |
| 1,109,635 | 9/1914 | Moffat . | |
| 1,139,863 | 5/1915 | Hayes, Jr. . | |
| 1,217,329 | 2/1917 | Moffatt . | |
| 1,243,160 | 10/1917 | Grieb . | |
| 2,549,057 | 5/1943 | Chinnici | 112/207 |
| 2,777,409 | 1/1957 | Winberg | 112/214 |
| 2,827,869 | 6/1956 | Nering | 112/207 |
| 2,967,498 | 5/1958 | Russell et al. | 112/207 |
| 3,162,158 | 7/1963 | Chudner | 112/207 |
| 3,262,410 | 7/1966 | Chernes | 112/212 |
| 3,530,809 | 9/1970 | Porter | 112/207 |
| 3,611,817 | 10/1971 | Smith | 112/313 |
| 3,636,899 | 1/1972 | Crisler | 112/207 |
| 3,995,571 | 12/1976 | Porter | 112/207 |
| 4,166,422 | 9/1979 | Porter | 112/311 |
| 4,285,294 | 8/1981 | Aida | 112/311 |
| 4,449,464 | 5/1984 | Porter | 112/311 |
| 4,546,716 | 10/1985 | Babson et al. | 112/162 |
| 4,589,364 | 5/1986 | Yamamoto et al. | 112/313 X |

FOREIGN PATENT DOCUMENTS

| | | |
|---|---|---|
| 7-9064 | 7/1932 | Japan . |
| 47-15384 | 5/1972 | Japan . |
| 47-18308 | 5/1972 | Japan . |
| 48-6892 | 2/1973 | Japan . |
| 49-37149 | 4/1974 | Japan . |
| 50-8653 | 1/1975 | Japan . |
| 50-11755 | 2/1975 | Japan . |
| 50-72451 | 6/1975 | Japan . |
| 50-146759 | 12/1975 | Japan . |
| 51-4855 | 2/1976 | Japan . |
| 51-98743 | 8/1976 | Japan . |
| 52-17055 | 2/1977 | Japan . |
| 53-25149 | 3/1978 | Japan . |
| 53-33746 | 3/1978 | Japan . |
| 54-92329 | 5/1979 | Japan . |
| 54-143520 | 5/1979 | Japan . |
| 47-18310 | 5/2672 | Japan . |

OTHER PUBLICATIONS

Union Special Machine Company catalog 103S, for Streamlined High Speed Overseamers, (Mar. 1966).

Union Special Technical Information, No. 18, (Jun. 23, 1978) re: Porter top feed mechanism.

Tokyo Juki Industrial Co. Ltd. brochure for MOU-814 series and MOU-816 series Catalog (Jun. 1980).

Tokyo Juki Industrial Co., Ltd., Parts book for model DLU-450 sewing machines, (Dec. 1977).

Tokyo Juki Industrial Co., Ltd., Parts book for model LU-562 and LU-563 sewing machines, (Sep. 1978).

Tokyo Juki Industrial Co., Ltd., Parts book for model MOU-800 series Variable Top Feed Overedger and Safety Stitcher sewing machine and T012C Automatic Chain-off Thread Trimmer sewing machine, (Apr. 1980).

Tokyo Juki Industrial Co., Ltd., Parts book for models MO-804, MO-814 and Mo-816 sewing machines, (May 1978).

Tokyo Juki Industrial Co., Ltd., Parts book for models MOR-2500, MOU-2500, MOR-2514-OD4-300, MO-R-2514-BD4-307, MOR-2516-DD4-300, NOU-25-14-BD4-307 and MOU-2516-DD4-300, (Mar. 1984).

*Primary Examiner*—Andrew M. Falik

*Assistant Examiner*—Paul C. Lewis

*Attorney, Agent, or Firm*—Wolf, Greenfield & Sacks

[57] ABSTRACT

The invention comprises improvements to sewing machines for increasing the throat clearance of the machine. The improvements relate to 1) modifications to mechanical components of the machine to increase the throw and upper travel limits of the presser foot, upper feeding foot, needle and spreader, 2) an adjustment for allowing the speed of the upper walking foot to be variable relative to the speed of the lower walking foot, and 3) an improved biasing spring for biasing the presser foot downward.

7 Claims, 10 Drawing Sheets

HIGH LIFT SEWING MACHINE

FIELD OF THE INVENTION

The invention relates to sewing machines. More particularly, the invention relates to sewing machines adapted for overcast stitching of thick materials.

BACKGROUND OF THE INVENTION

Industrial sewing machines have long been used for sewing together relatively thick materials such as mattress cover$ and upholstery. Sewing machines used for sewing such thick materials must be adapted to provide adequate vertical clearance for the material to fit through the throat of the machine. The throat plate, the plate upon which the material rests as it is sewed, defines the bottom plane of the space in which the material must fit in the throat of the machine. Accordingly, the thickness of the material which can be sewn by the machine is dictated by the clearance between the throat plate and the lowest of the upper travel limit of the 1) needle, 2) presser foot and 3) upper walking foot. Although the needle, presser foot and upper walking foot must provide an unusually large clearance when at their upper travel limit, the needle must still be able to plunge below the throat plate to place a stitch in the material. Accordingly, the needle's throw (i.e., the distance traveled by the needle from the top of its motion to the bottom) on such a machine must also be unusually long. If the machine is to be able to be used with thin as well as thick materials, the same is true of the throw of the presser foot and the upper walking foot. The presser foot and upper walking foot must be able to get very close to the throat plate in order to contact very thin materials but also must be able to provide larger clearance for very thick materials.

Typically, the lower travel limit of the presser foot in a sewing machine is limited by contact of the presser foot with the throat plate. However, this manner of limiting motion is undesirable because the impact of the presser foot with the throat plate causes unnecessary wear and tear on the components of the device. It is also desirable to be able to adjust the downward force of the presser foot on the material in order to accommodate for materials of different thickness.

In sewing machines which comprise upper walking feet, the upper walking foot is typically positioned directly over the lower walking foot so that the material is "clamped" between the upper and lower walking feet. U.S. Pat. No. 4,449,464 discloses a sewing machine including upper and lower walking feet. Some sewing machines also include a secondary (or rear) lower walking foot spaced rearwardly of the upper walking foot and primary lower walking foot. Reference is made to U.S. Pat. Nos. 4,166,422, 3,995,571 and 3,530,809 as examples of sewing machines comprising mating upper and lower walking feet and an additional secondary lower walking foot spaced rearwardly away from the other walking feet. In certain sewing situations, it is desirable for the various walking feet to move at different speeds relative to one another. This is typically useful where one wishes for the material to bunch as it is sewed. For instance, when bunching of the material is desired, the forward lower walking foot should move at a speed slower than the rearward lower walking foot. Forward is defined herein as the direction in which the material is advanced as it is sewn. In fact, in certain applications, it is desirable for the upper walking foot to travel at a different speed than the primary lower walking foot (which it is directly above), thus causing the upper layer of material to travel at a different speed than the lower, causing only one of the layers to bunch as it is sewed.

In overcast stitching, thread is wrapped once around the edge of the material for each stitch. In machines adapted for performing overcast stitching, two strands of thread, an upper strand which is looped through an eye in the tip of the needle and a lower strand which is looped through a looper below the throat plate, are intertwined to form the overcast stitches. The stitch will not be described herein as it is conventional in the art and not material to the present invention except insofar as improvements have been made to certain mechanical components of an overcast stitching sewing machine. Accordingly, the following discussion of overcast stitching is not intended to be complete but simply describes the necessary machine components for accomplishing overcast stitching.

FIGS. 1A 1B and 1C illustrate the movement of the needle, looper and spreader of an overcast stitching sewing machine through one stitch cycle. The strands of thread are not shown for ease of illustration. When the tip of the needle 70 is plunged below the throat plate 11, as shown in FIG. 1A, a looper 183, rotating about axis 187 in the direction of arrow 65, passes close by the needle tip and traps the upper thread from needle 70 underneath arm 183*a*. Looper 183 transports the trapped thread horizontally beyond the edge of the material 77 as the needle continues its stroke and begins moving upwardly, as illustrated in FIG. IB. When the looper reaches beyond the edge of the material (FIG. 1B), spreader 180, moving upwardly, grabs the lower thread from looper 183 by trapping it in fork 182 and transports it around the edge of the material bringing it up and over the material and positioning it adjacent the tip of needle 70 as the needle reaches the top of its throw and begins its downward stroke again (FIG. 1C). The needle removes the thread from the spreader by trapping it between the needle tip and the upper thread strand which passes through the eye 67 in the needle tip. At the moment when the thread is trapped by needle 70, spreader 180 reaches the top of its stroke and reverses direction, moving downwardly and to the right, releasing the thread from fork 182. The needle then plunges through the material transporting the thread grabbed from the spreader through the material causing a stitch to be formed over the edge of the material returning to the position shown in FIG. 1A. The apparatus then repeats the cycle to make the next stitch.

Commonly, an overcast stitching machine is also provided with a knife system comprising upper and lower knives which cut the material just before it is advanced through the sewing area so as to form the edge close to the needle and parallel to the stitching. The knife assembly is rearwardly of the sewing area and typically comprises a stationary lower knife and a reciprocating upper knife which moves up and down to meet with the lower knife during the lower portion of its travel to act as a scissor to cut the material before it is advanced into the sewing area.

Accordingly, it is an object of the present invention to provide an improved sewing machine.

It is a further object of the present invention to provide a sewing machine with a very large vertical clearance between the throat plate and the upper travel limits of the needle, presser foot and upper walking foot.

It is yet another object of the present invention to provide a sewing machine with variable speed walking feet.

It is yet another object of the present invention to provide a sewing machine in which the lower travel limit of the presser foot is adjustable relative to the throat plate.

It is a further object of the present invention to provide a sewing machine in which the downward force of the presser foot can be set to any desired force.

It is another object of the present invention to modify existing sewing machines to improve their utility.

It is yet one more object of the present invention to provide an overcast stitch sewing machine having high clearance for accepting thick materials and having an increased throw and upper travel limit of the spreader.

SUMMARY OF THE INVENTION

The invention comprises a sewing machine that is particularly adapted for overcast stitching thick materials. The invention, however, can be adapted to other types of sewing machines.

The present invention resides partially in improvements which can be made to an existing sewing machine, and particularly the Model 515-4-26 sewing machine sold by Pfaff Pegasus of U.S.A. of Atlanta, Ga., in order to allow it to accept thicker materials than the original machine. The invention, however, comprises improvements which can be made to any machine. Further, certain aspects of the invention comprise inventive apparatus which can be embodied in any sewing machine.

The sewing machine of the present invention comprises a biasing assembly for biasing the presser foot downwardly towards the throat plate to firmly hold the material stationary while the needle is in the material. The biasing assembly may comprise a fixed tubular housing containing first and second helical die springs and three spacers with longitudinal flanges which extend inside the helical die springs and prevent them from bending or collapsing internally. Spacers of varying length can be employed depending on the desired force of the downward bias. A preload spacer is in contact with the roof of the tubular housing. The preload spacer is followed by a first spring, a second spacer, a second spring and then a third spacer adapted to engage, at its lower end, an arm connected to the presser foot. The bottom of the tubular housing is adapted to threadedly accept a cap nut at its lower end. The cap nut has an opening in its end through which the upper end of the rod on which the presser foot is mounted extends into the tubular housing. The upper end of the presser foot rod includes an outwardly extending flange so that the upper end of said presser foot arm cannot pass through the opening, but the remainder of the rod can slide freely in the opening. The lower limit of the throw of the presser foot is limited by the cap nut. The lower limit of travel of the presser foot can be adjusted by the number of revolutions that the cap nut is screwed into the threaded tubular housing. A cushion such as a urethane pad is fixed to the inner surface of the cap nut so as to cushion the impact of the outwardly extending flange of the presser foot rod when it strikes the cap nut.

According to another aspect of the invention, the machine comprises forward and rear lower serrated walking feet and an upper serrated walking foot. All of the walking feet have elliptical cycles such that they come in contact with the material lying on the throat plate as they are moving forward and thus grab the material and advance it between needle strokes. The upper walking foot is positioned directly above the forward lower walking foot. Both lower walking feet travel in elliptical motion rising above the throat plate near the top of their motion to engage the material and feed it forward. The upper walking foot has clockwise elliptical motion and engages the material from above during the lower portion of its travel. Although both lower walking feet are driven by the same reciprocating shaft, the speed of the rear lower walking foot is adjustable relative to the speed of the forward lower walking foot. This is accomplished by making the moment arm coupling the rear walking foot to the drive shaft adjustable in length. In the present invention, the upper walking foot also has variable speed relative to the forward lower walking foot (to which it is adjacent) by virtue of being connected to the same moment arm as the rear lower walking foot.

To increase the throat clearance of the sewing machine, the needle housing is raised. The needle drive shaft and, through the needle drive shaft, the needle, presser foot and upper walking foot, are mounted to the needle housing. The needle housing is raised by insertion of a trapezoidal wedge between the needle housing and the lower housing. The upper and lower surfaces of the wedge are angled such that the needle housing is tilted 4° from its original orientation. The needle guide tube, through which the needle travels, is also mounted to the needle housing. Accordingly, the angle of the needle is also changed 4°. The angle change is necessary because, in certain types of sewing machines, the needle is angled slightly from the vertical position. If the needle height is raised without changing its angle, the needle will traverse a course parallel to its original course but displaced in a direction perpendicular to the direction of motion of the needle. Since the direction of the motion of the needle is not vertical, this displacement includes a horizontal component. This horizontal displacement, without angle correction, would cause the needle to no longer meet with the looper or spreader at the same points. Accordingly, the trapezoidal wedge imparts an angle change to the path of travel of the needle as required to cause the needle to meet with the looper and spreader.

According to another aspect of the invention, the throw of the spreader of this machine is increased by replacing a single arm connecting the vertical spreader shaft to a horizontal drive shaft with a multiple arm arrangement in order to increase the throw of the spreader without significantly increasing the horizontal distance between the horizontal drive shaft and the vertical spreader shaft. In one possible embodiment, the single arm is replaced with two shorter, overlapping arms. One end of the first arm is connected to the drive shaft and the other end is connected to the second arm at a point intermediate the ends of the second arm. The second arm is coupled to the spreader shaft at one end The other end of the second arm is pivotally fixed at a point between the drive shaft and the spreader shaft. As the drive shaft rotatedly reciprocates, the end of the second arm which is coupled to the spreader shaft travels a greater vertical distance than if a single arm linkage of the same length was used. Accordingly, the spreader shaft and spreader travel a greater vertical distance.

The length of the spreader shaft has been increased so that the increased throw does not change the lower limit of the throw of the spreader shaft. Accordingly, the additional throw achieved by the above-described double arm arrangement is manifested as an increase in the upper travel limit of the spreader while the lower travel limit of the spreader remains the same.

Additionally, the machine comprises upper and lower knives for scissoring off the edge of the material as it is advanced through the machine. The lower knife is stationary while the upper knife is mounted to a reciprocating shaft by an arm causing the knife to travel in an arc and meet the lower knife during the lower portion of its travel. In order to create room for the lengthened spreader shaft, the knife arm was rotated upwardly on the shaft. In order to cause the upper knife to still mate with the lower knife and not interfere with the operation of the spreader, a spacer was added at the end of the knife arm to position the knife further rearwardly and lower it back down to almost its original height. The lower knife holder was replaced with a new holder which positions the lower knife further rearwardly also so that it still mates with the upper knife.

Since the needle was raised by the addition of the wedge, its throw had to be increased so that it still plunged below the throat plate to meet with the looper. The needle is driven by a reciprocating needle drive shaft in the needle housing. The needle drive shaft itself is driven by a generally vertical connecting member which is connected at its upper end to the needle drive shaft via a connecting arm and at its other end to the main reciprocating drive shaft in the lower housing. The connecting member is lengthened to accommodate the increased distance between the main drive shaft and needle drive shaft caused by the addition of the wedge. Further, the throw of the needle was increased by shortening the arm connecting the vertical connecting member to the needle drive shaft. Accordingly, the same amount of vertical travel of the vertical connecting member produces greater rotation of the needle drive shaft. The needle drive shaft diameter at the point where it is coupled to the arm is reduced from the nominal shaft diameter to accommodate the now closer drive bar which would otherwise strike the original diameter needle drive shaft and prevent the machine from operating.

The clearance of the presser foot over the throat plate has been increased by lengthening the arms which urge the presser foot upwardly when the needle exits the material.

DETAILED DESCRIPTION OF THE INVENTION

The present invention reside partially in improvements which can be made to an existing sewing machine and particularly the model 515-4-26 sewing machine sold by Pfaff Pegasus of U.S.A. of Atlanta, Ga. (hereinafter Pegasus sewing machine) in order to increase the clearance between the throat plate and the upper travel limits of the presser foot, needle and upper walking foot so that the machine can accommodate thicker materials. However, the invention comprises improvements over the sewing machine art in general.

Figure 1A:
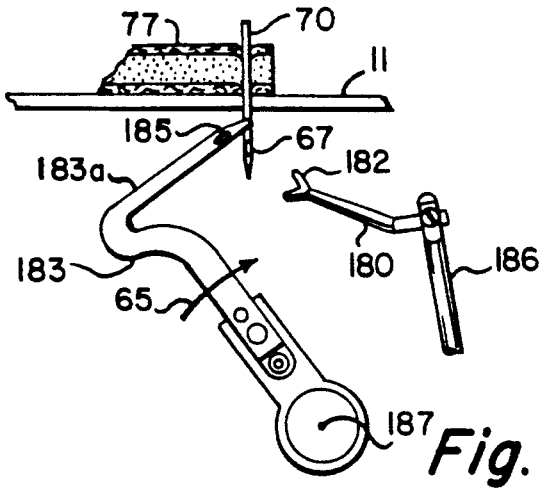
FIGS. 1A, 1B and 1C are side views illustrating the relative positions of the needle, looper and spreader of an overcast stitching sewing machine in three successive states comprising the stitch cycle of such a sewing machine.
Figure 1B:
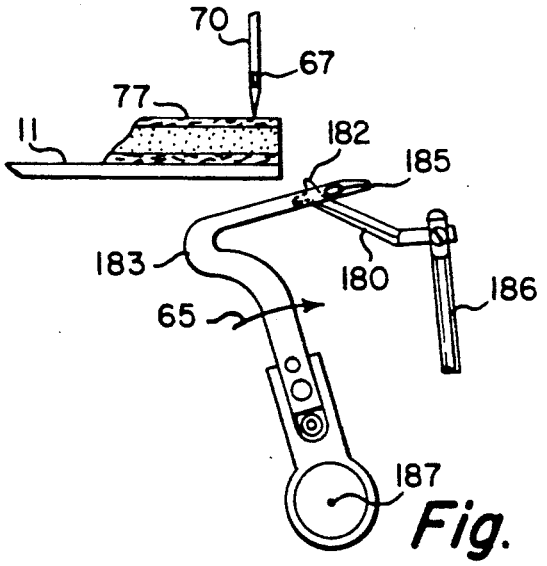
Figure 1C:
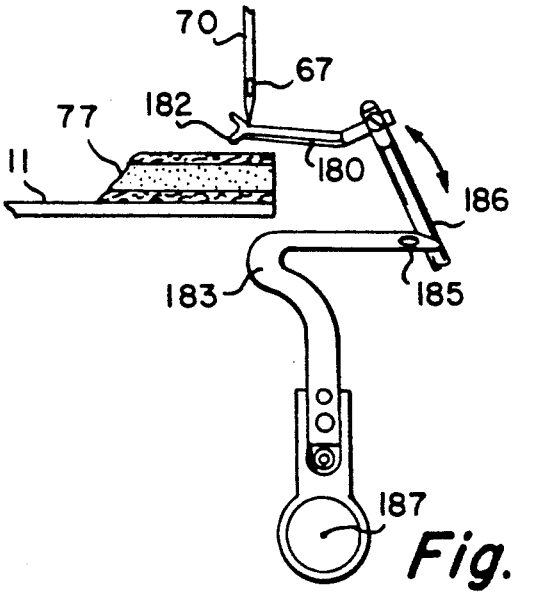
Figure 2:
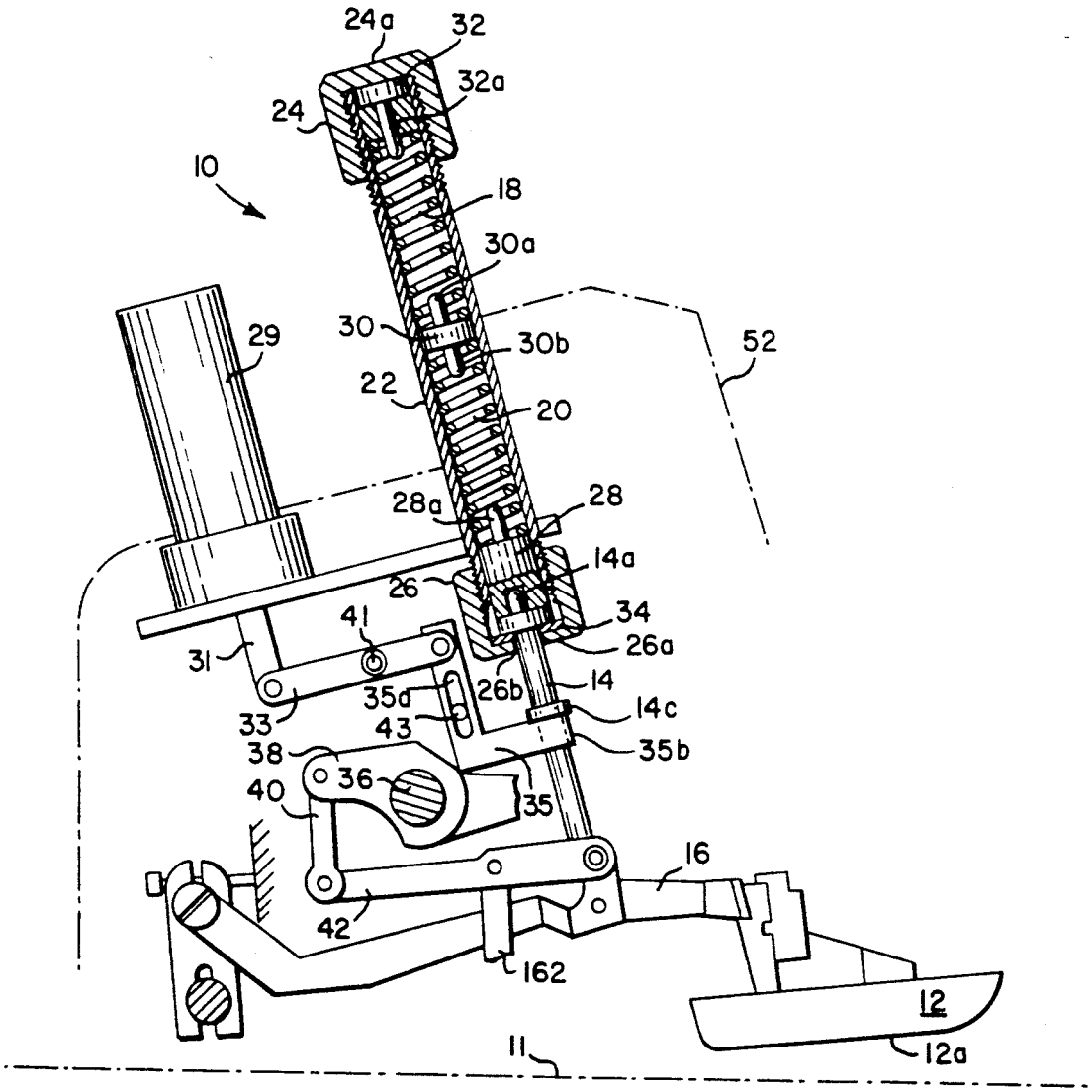
FIG. 2 is a simplified side view of the sewing machine of the present invention in partial cross-section illustrating the presser foot biasing structure of the present invention.

FIG. 2 is a simplified side view, in partial cross-section, of a mechanism for causing the presser foot of a sewing machine to reciprocate in vertical motion so as to clamp the material to the throat plate when the needle is in the material and to rise and release the material when the needle exits the material so that the material can be advanced by walking feet before the next stitch. The presser foot 12 is permanently biased downwardly by a biasing mechanism 10. Means are provided for manually lifting the presser foot (and upper walking foot) prior to operation in order to initially insert the material to be sewed in the throat of the machine. A hydraulic cylinder 29 can be manually operated to raise the presser foot 12. Shaft 31 is coupled to presser foot connecting member 14 via arms 33 and 35. Connecting member 14 may be a cylindrical rod. Upon activation, shaft 31 is extended out of hydraulic cylinder 29 causing arm 33 to rotate counter clockwise about pivot 41 thus lifting arm 35. End **35*b* of arm 35 extends below a flange 14*c* on rod 14 and lifts presser foot rod 14 and presser foot 12 by exerting an upward force on flange 14*c*. Arm 35 is slotted at 35*a*. A pin 43 is fixedly attached to a wall behind arm 35 and extends through slot 35*a*. Thus, arm 35 can slide up and down and rotate about pin 43. As will be explained in greater detail with respect to FIGS. 5A and 5B, the upper walking foot is coupled to rod 14** via linkages 42 and 162 such that the lifting of presser foot rod 14 also lifts the upper walking foot.

During sewing operation, the presser foot is urged upwardly at fixed intervals by a reciprocating drive shaft 36 as will be described in greater detail herein. The presser foot biasing mechanism 10 is shown in cross-section in FIG. 2. The presser foot 12 is coupled to rod 14 by means of a presser foot arm 16. Rod 14 is biased downwardly by biasing means such as helical die springs 18 and 20 contained in tubular housing 22. Housing 22 includes upper cap nut 24 and lower cap nut 26. The ends of housing 22 are externally threaded so that the internally threaded cap nuts 24 and 26 can be screwed onto the opposing ends of housing 22. Roof 24*a* of upper cap nut 24 is solid. Floor 26*a* of lower cap nut 26 comprises an opening 26*b* through which rod 14 slideably travels. The upper portion of rod 14 includes a transverse flange 14*a* which is wider than opening 26*b*such that the flange cannot pass through hole 26*b*, thereby trapping the upper portion of rod 14 within the presser foot biasing mechanism 10. A longitudinal flange 14*b* extends upwardly from rod 14 and fits within a slot in spacer 28. Spacer 28 includes a longitudinal flange 28*a* which extends upwardly through the center of helical spring 23. A second spacer 30 is positioned between helical springs 18 and 20 and has opposing flanges 30*a* and 30*b* extending therefrom through the centers of springs 18 and 20, respectively. A preload spacer 32 is positioned between the upper end of spring 18 and roof 24*a* of upper cap nut 24. Longitudinal flange 32*a* extends from preload spacer 32 through the center of helical spring 18.

Floor 26*b* of cap nut 26 defines the downwardmost position of presser foot arm 14 and thus presser foot 12. The spring lengths and spacer lengths are chosen such that the springs are at least slightly compressed when transverse flange 14*a* of rod 14 is in its downwardmost position in which flange 14*a* abuts against the floor 26*b* of bottom cap nut 26. A cushioning member such as polyurethane pad 34 is attached to the inner surface of floor 26*b* so as to cushion the impact of flange 14*a* against the floor 26*b*.

Longitudinal flanges 28*a*, 30*a*, 30*b* and 32*a* of the spacers 28, 30 and 32 assist in preventing the springs from bending since they extend through the center of the helical springs. Accordingly, the longitudinal flanges 28*a*, 30*a*, 30*b* and 32*a* should be as long as possible.

The length of the flanges, however, is limited by the uppermost possible position of rod 14. That is, for instance, if the spring is compressed enough, the top part of flange 28*a* will hit the bottom part of flange 30*b*. Accordingly, these flanges must be short enough such that they will not prevent the rod 14 from reaching what would otherwise be its uppermost possible position.

Since upper cap nut 24 can be easily removed from the tubular housing by unscrewing it, preload spacer 32 can be replaced quickly with a spacer of a different length when it is desired to change the downward compressor force of presser foot 12 as, for instance, may be the case when significantly changing the thickness of the material which is being sewed. As the material becomes increasingly thicker, the downward pressure of presser foot 12 on the material increases because the spring will be compressed more when presser foot 12 is resting on top of the material. Accordingly, in such a situation, if the force is too great, preload spacer 32 can be replaced with a shorter preload spacer thus reducing the compression of the springs. In fact, since upper cap nut 24 is removable the springs themselves can be easily replaced if desired.

Further, the lower travel limit of presser foot 12 is limited by the position of floor 26*b* of lower cap nut 26 and the thickness of polyurethane pad 34. Accordingly, by proper positioning of floor 26*b*, presser foot 12 can be prevented from crashing into the throat plate 11, thus reducing wear of the components of the machine. Since lower cap nut 26 is engaged to housing 22 by thread means, the height of floor 26*b* can be adjusted by screwing or unscrewing lower cap nut 26 to the desired extent.

Figure 3:
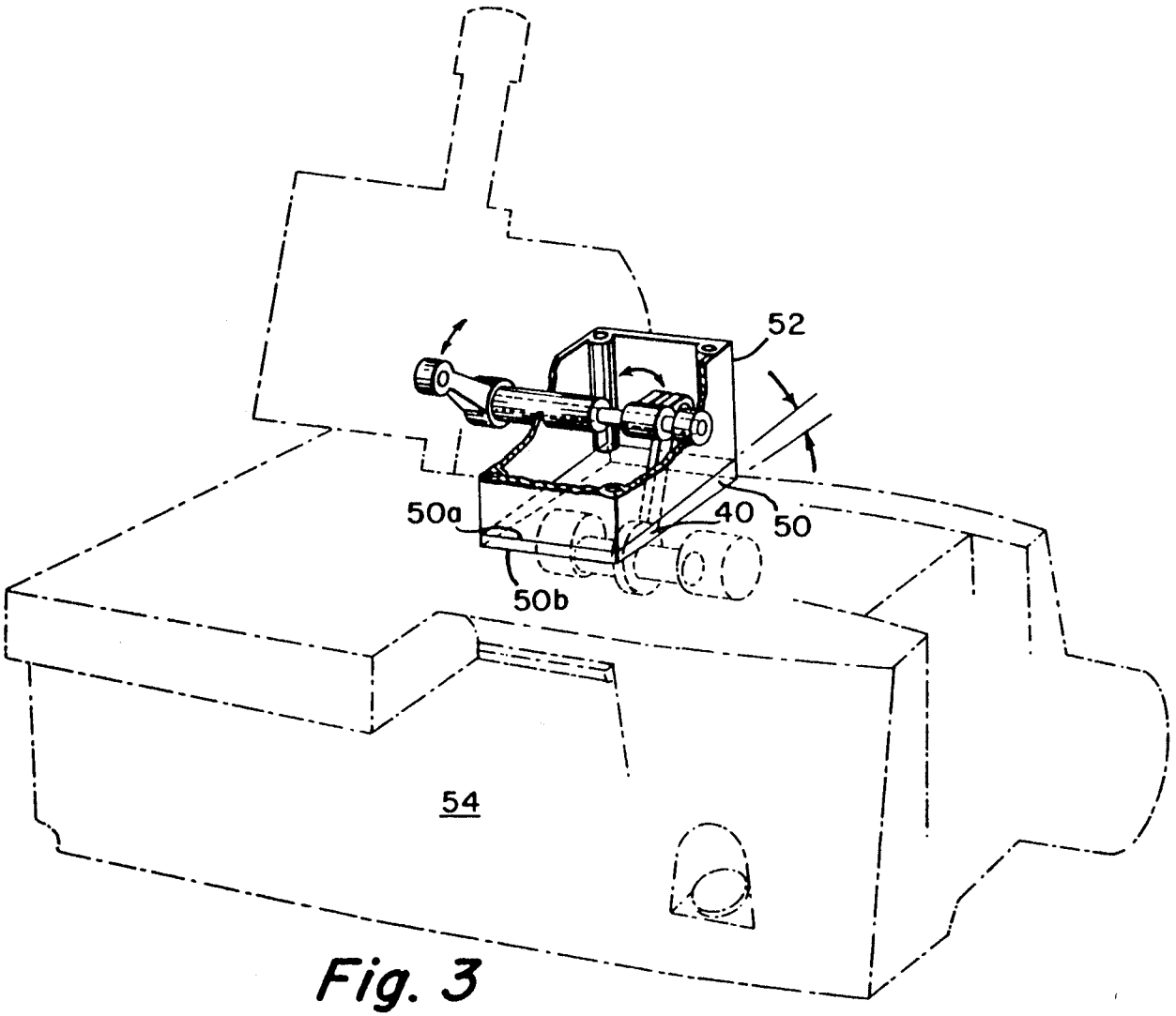
FIG. 3 is perspective view illustrating a trapezoidal wedge used to increase the clearance of the needle, presser foot and upper walking foot of the sewing machine of the present invention.
Figure 5A:
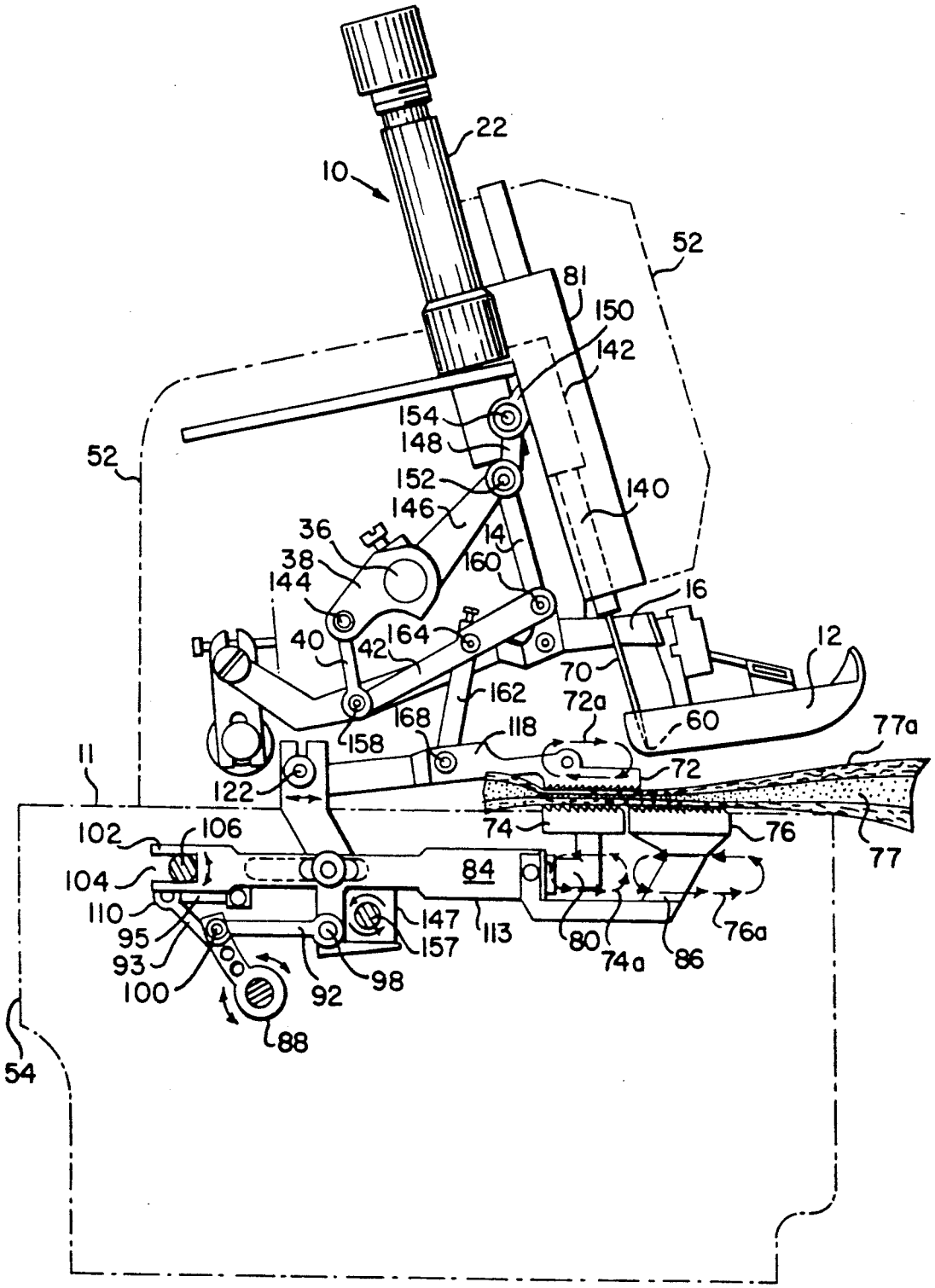
FIG. 5A is a simplified cut away side view of the mechanism for operating the presser foot, needle, and walking feet of the sewing machine of the present invention when the machine is in a first condition.
Figure 5B:
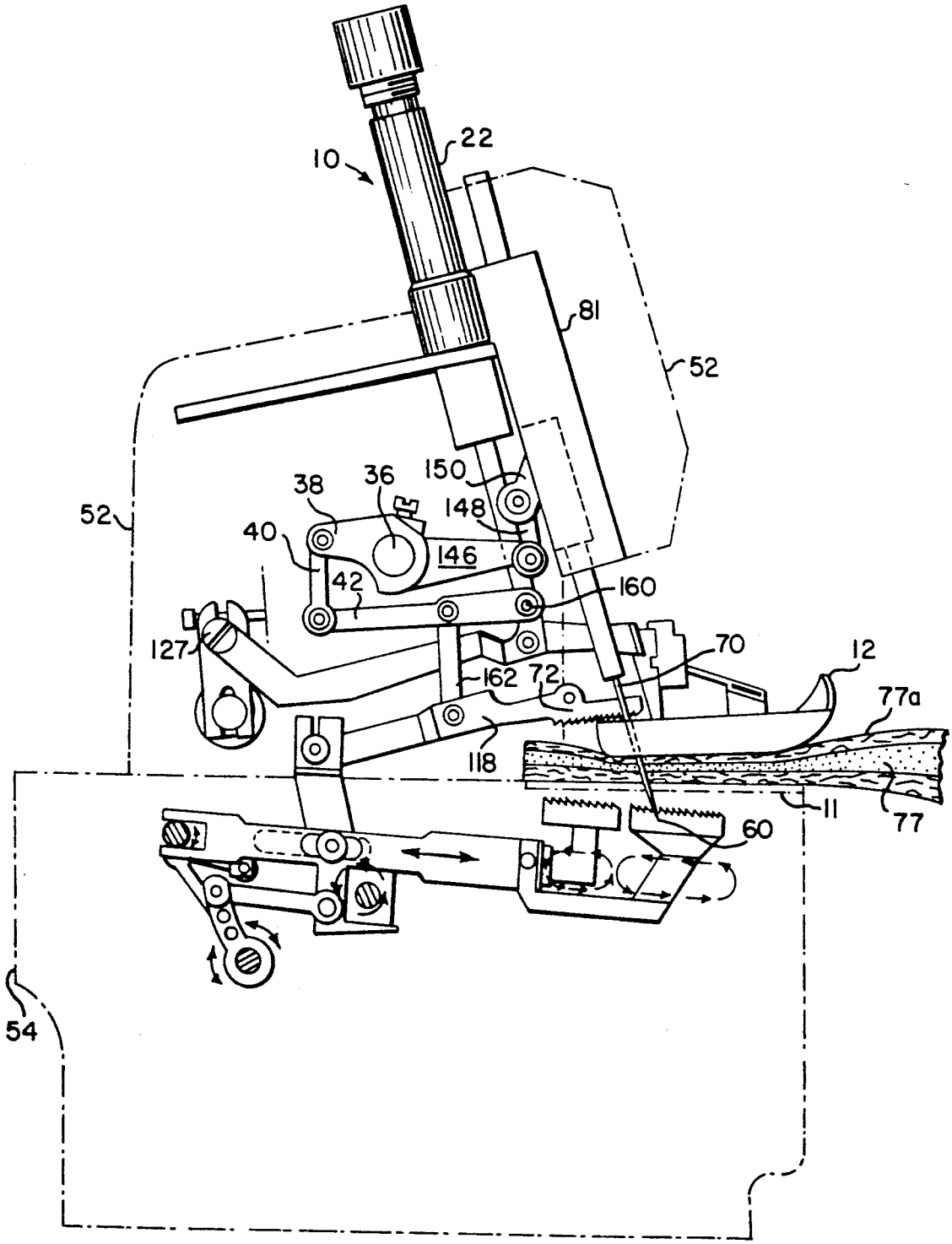
FIG. 5B is a simplified cut away side view of the mechanism for operating the presser foot, needle, and walking feet of the sewing machine of the present invention when the machine is in a second condition.

FIG. 3 illustrates another aspect of the improvements made to the Pegasus machine. FIG. 3 is a perspective view of the sewing machine illustrating the trapezoidal wedge 50 used to increase the throat clearance of the sewing machine. Wedge 50 is also shown in cross section in FIGS. 7A and 7B. In accordance with the present invention, wedge 50 is inserted between the needle housing 52 and the main housing 54. The needle guide shaft, the hollow tubular shaft through which the needle travels, as well as the needle drive shaft 36 are fixedly attached to the upper housing. The needle guide shaft does not appear in FIG. 3, but is shown in FIGS. 5A and 5B and is designated with reference number 81. The raising and tilting of needle housing 52 by the insertion of trapezoidal wedge 50, thus raises and tilts the needle.

Figure 4:
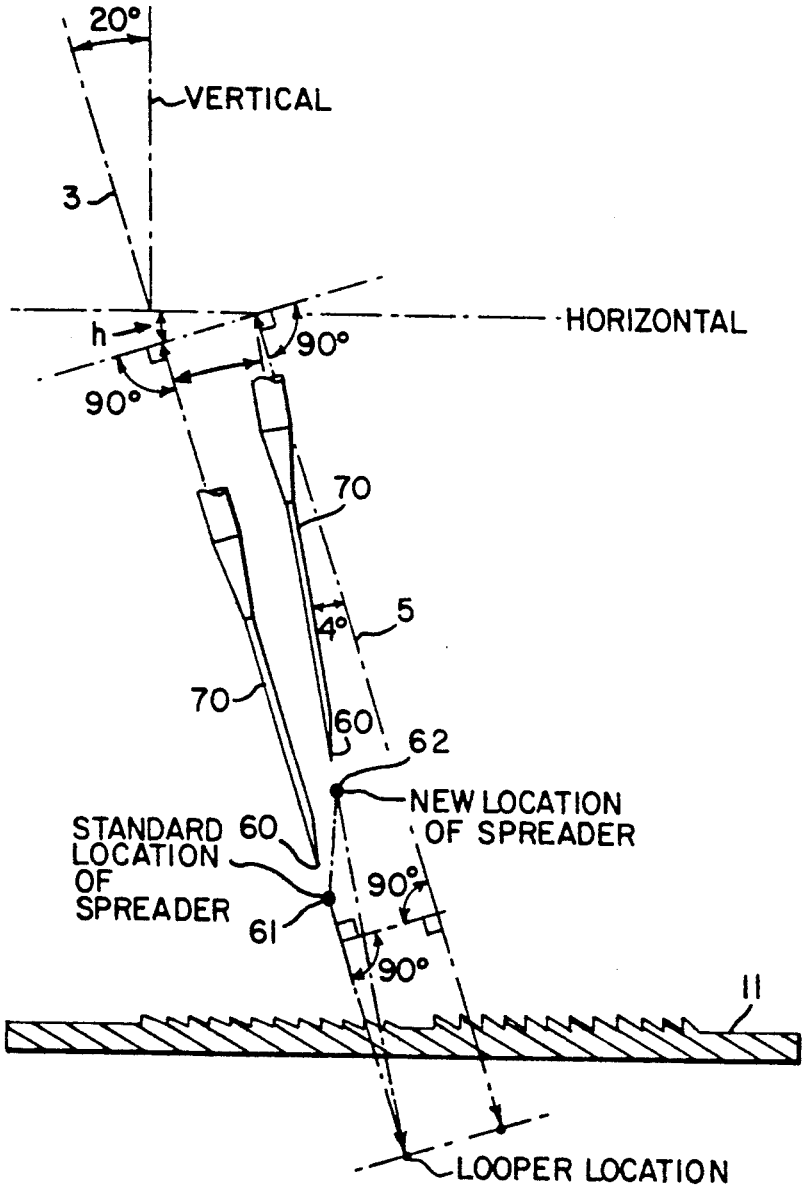
FIG. 4 is side view illustrating the relative relocation of the needle accomplished by the insertion of the wedge shown in FIG. 2 in the sewing machine of the present invention.

As illustrated in FIG. 4, in the original Pegasus sewing machine, the needle is angled from the vertical by approximately 20°. Thus, if the height of the needle is raised without changing the angle of the needle, the needle will travel in a path along line 5 in FIG. 4 parallel to its original path along line 3 but displaced therefrom by a predetermined distance perpendicular to the original path. The upper travel limit of the needle tip (as well as the lower travel limit) is raised by height h in FIG. 4. However, if the angle of the needle is not changed, the needle will not meet the spreader or the looper in the original locations. The shift in the needle path is not too significant with respect to meeting with the looper. The looper typically has a fairly long horizontal throw and will still be able to catch the thread off of the needle, particularly if the throw of the needle is increased so that the lower travel limit of the needle is not significantly changed in the vertical direction from the original needle path.

Figure 7B:
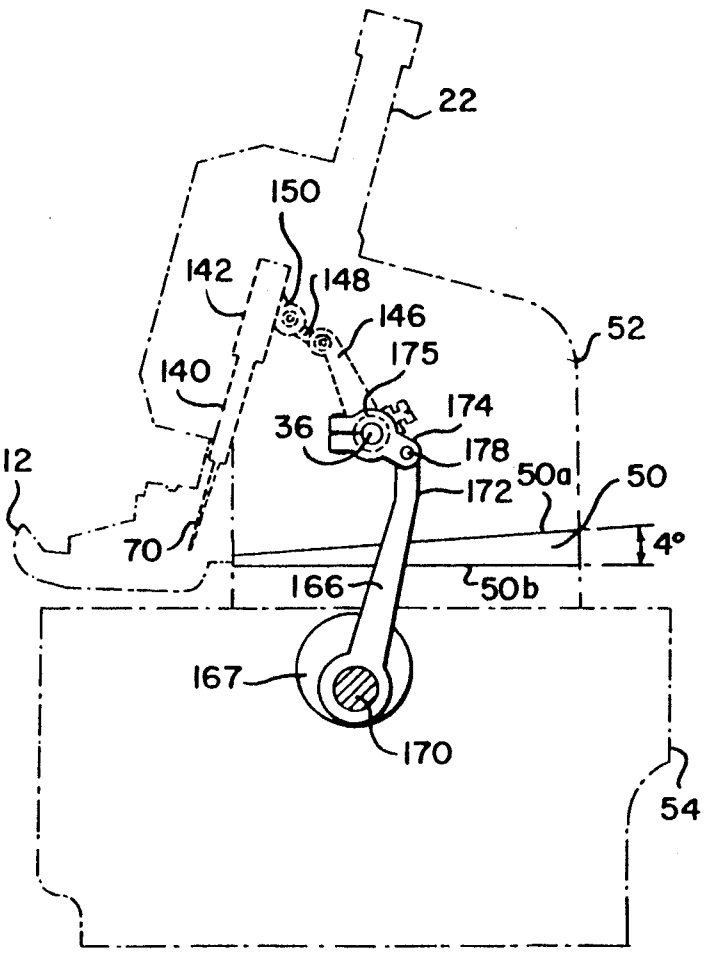
FIGS. 7A and 7B are simplified cut away side views showing the mechanism for driving the needle drive shaft in the present invention at two different instances during the drive cycle.
Figure 7A:
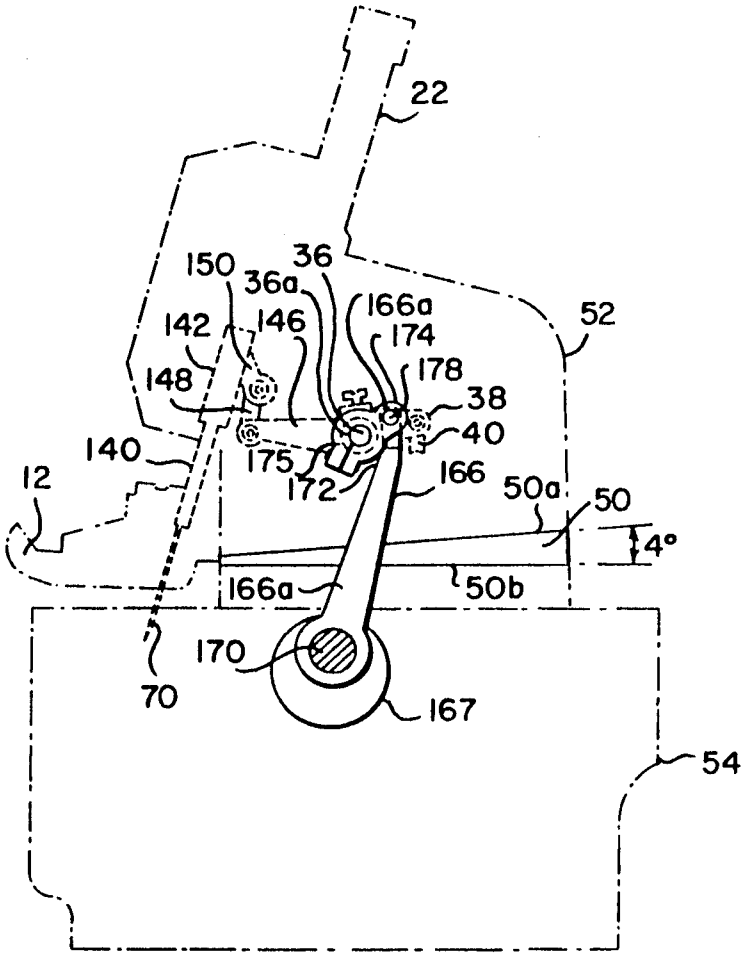

However, the relative position of the needle and spreader when they are to exchange thread must be maintained to a fairly high tolerance. As will be described herein in greater detail with respect to FIGS. 8A and 8B, the path of the spreader has also been modified in the present invention such that the spreader should now meet the needle at point 62 as opposed to point 61. As shown in FIG. 4, point 62 would not be on the path traversed by the needle if its angle was not changed. In order to cause the needle to still meet with the spreader within acceptable tolerance limits, the angle of the needle must be reduced about 4° from the vertical. Accordingly, the side cross-section of wedge 50 (as shown in FIGS. 7A and 7B) instead of being square, is trapezoidal, with the upper surface 50*a* angled about 4° relative to the bottom surface 50*b*.

Figure 6:
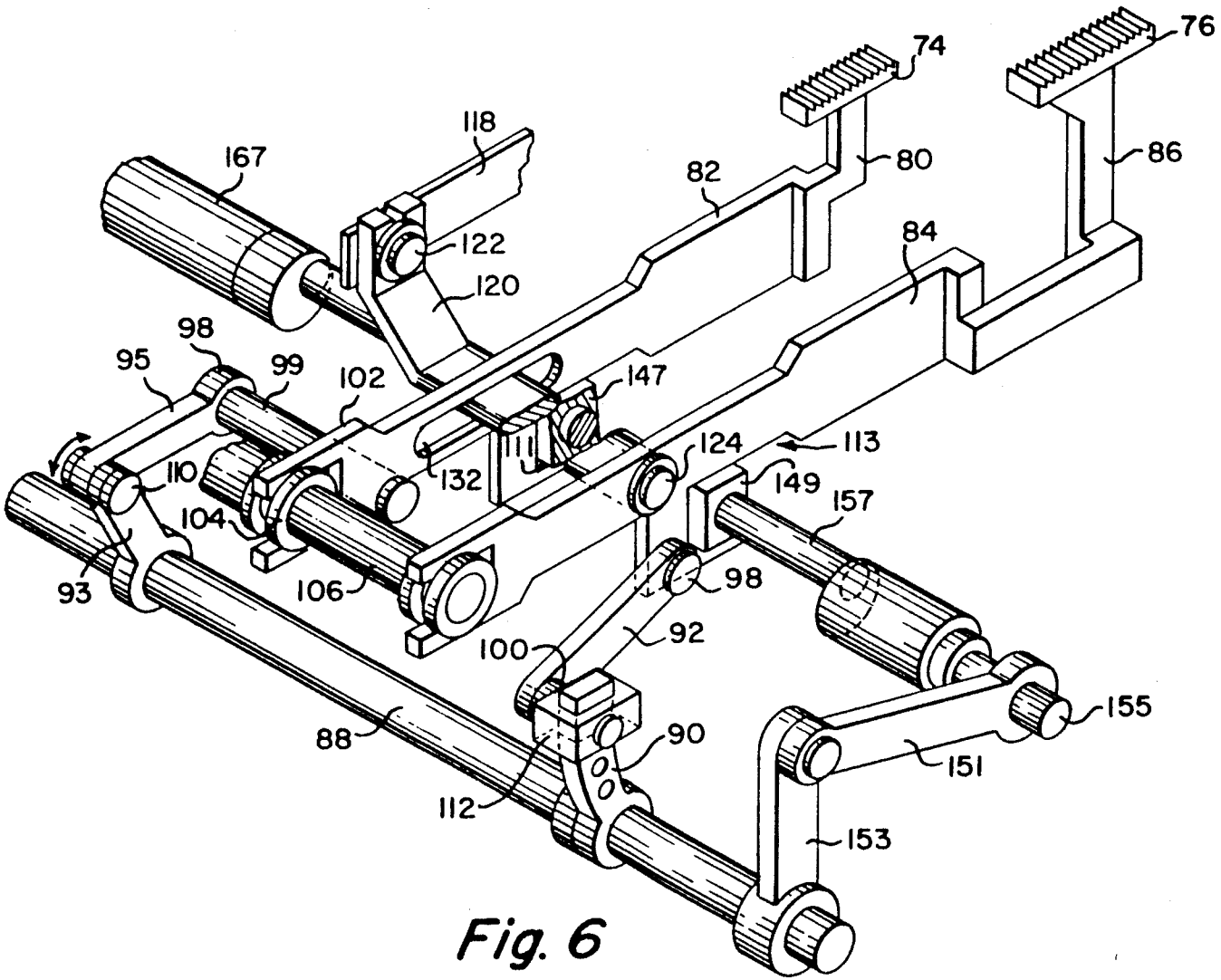
FIG. 6 is a perspective view of the lower walking feet and walking feet mechanism of the present invention shown in more detail than in FIGS. 5A and 5B.

FIGS. 5A and 5B are simplified cut away side views of the sewing machine of the present invention at two different stages. FIGS. 5A and 5B are greatly simplified to ease the understanding of the invention. For instance, FIGS. 5A and 5B do not show the looper or the spreader. FIG. 6 is a simplified perspective view of some of the components in lower housing 54 of FIGS. 5A and 5B. In FIG. 5A, the needle is withdrawn from the material and the presser foot 12 is not engaged with the material. At this moment, upper walking foot 72 and lower walking feet 74 and 76 are engaged with the material and moving leftward in the figure. In FIG. 5B, the needle is in the material, the presser foot is clamping the material down to the throat plate and the upper and lower walking feet 72, 74 and 76 are not engaged with the material and are moving towards the right.

The desired cyclical movement of the needle, presser foot and all walking feet will be described at first without reference to the mechanical structure for causing the movement.

In general, one or more layers of material 77 are laid on the throat plate 11. Presser foot 12 is biased downwardly onto the upper surface 77*a* of the material and presses the material against throat plate 11. At this time, upper walking foot 72 is in its raised position so that it is not in contact with the material. Lower walking feet 74 and 75 are below the throat plate so that they do not engage the material. Presser foot 12 remains pressed against material 77 as the needle 70 advances in and through the material 77. Near the bottom of its travel limit, when the tip 60 of the needle is below the throat plate 11, a looper (not shown in FIGS. 5A and 5B) passes closely by the tip 60 of the needle to partially complete the stitch in a manner which is known in the art.

At essentially the same moment that the needle tip 60 exits from the material during its upward stroke (i.e., the point where the tip 60 of needle 70 is even with bottom surface 12*a* of presser foot 12), presser foot 12 begins to rise off of the material. Simultaneously, upper walking foot 72 lowers and lower walking feet 74 and 76 raise to engage the material. All of walking feet 72, 74 and 76 travel in elliptical paths illustrated by arrows 72*a*, 74*a* and 76*a*, respectively, in FIG. 5A such that when the walking feet are engaging the material, they are moving in the forward direction (i.e., to the left in FIGS. 5A and 5B) and thus advance the material. Due to the elliptical motion of the walking feet, they eventually disengage the material 77 and begin traveling rearward to be prepared to advance the material after the next stitch. Just before the walking feet disengage the material, presser foot 12 once again lowers into contact with the material starting the cycle all over again.

The mechanism for causing all of this action to occur at the appropriate instances will now be described in detail with respect to FIGS. 5A, 5B and 6. Primary lower walking foot 74 is coupled via arm 80 to primary lower walking foot bar 82. Secondary lower walking foot 76 is coupled via arm 86 to secondary lower walking foot bar 84. In the view of FIGS. 5A and 5B, bar 82 is directly behind, and therefore obscured by, bar 86. Both bars can be seen in FIG. 6.

The vertical component of the motion of primary lower walking foot 74 is provided by walking foot drive shaft 88 via arm 93 and linkage 95. Drive shaft 88 is driven to reciprocate approximately ¼ of a revolution by main drive shaft 167 via arms 151 and 153 and off center sub shaft 155. This causes arm 93 to rock back and forth as illustrated by arrows 96. One end of linkage 95 is coupled to arm 93 at pivot 110 while the other end is coupled to primary walking foot bar 82 by pivot shaft 99 which is fixedly attached to bar 82 at one end and pivotally attached to linkage 95 by pivot 98 at the other end. End 102 of bar 82 comprises a slot 104 through which passes a fixed guide bar 106. Guide bar 106 fixes end 102 of bar 82 vertically, however, slot 104 allows bar 82 to slide horizontally relative to guide bar 106. Bar 82 slides horizontally in response to the motion of the walking foot drive shaft 88 transmitted to bar 82 via arm 93 and linkage 95.

Secondary lower walking foot bar 84 is driven off of shaft 88 via a second arm 90 and linkage 100. However, whereas in the primary lower walking foot mechanism, pivot 110 on arm 93 is fixed at a specified distance from drive shaft 88, in the secondary lower walking foot mechanism, pivot point 100 connecting arm 90 to linkage 92 is adjustable. The specific mechanism utilized for adjusting pivot point 100 is not shown for ease of illustration. However, it should be understood that mounting box 112 can be loosened and slid up or down on arm 90 and then re tightened to fix pivot point 100 at the desired distance on arm 90 from shaft 88. In this manner, the speed of secondary lower walking foot 76 can be changed relative to the speed of primary lower walking feet 74. This is the result of simply making the moment arms (i.e., the distance between the drive shaft 88 and the pivots 100 and 110) different. For instance, if the moment arm of the secondary walking foot is longer than the moment arm of the primary lower walking foot, then, for any given rotation of the drive shaft 88, pivot point 100 (and thus walking foot 76) will traverse a greater distance than pivot point 110 (and thus walking foot 74). Accordingly, secondary lower walking foot 76 will traverse a greater distance than primary lower walking foot 79 in the same period of time (i.e., it will travel faster).

As previously noted, the motion of walking feet 74 and 76 is not strictly horizontal but is elliptical, having a small vertical component. The vertical component of the motion of lower walking feet 74 and 76 is provided by off center sub shaft 157 of main drive shaft 167. Unlike the other drive shafts discussed herein, main drive shaft 167 does not reciprocate but simply rotates in a clockwise direction. Blocks 147 and 149 are mounted on off center sub shaft 157 and are positioned within horizontal slots 111 and 113 of bars 82 and 84, respectively. The rotation of main drive shaft 167 causes sub shaft 157 and blocks 147 and 149 to travel in circles. The vertical component of the circular motion of blocks 147 and 149 is transmitted to bars 82 and 84. The horizontal component of their motion is not transmitted to the bars since blocks 147 and 149 can slide horizontally in slots 111 and 113, respectively.

The horizontal component of the elliptical motion of upper walking foot 72 is provided by connection of upper walking foot 72 via linkage 118 and arm 120 to secondary lower walking foot bar 84. As shown in FIG. 5A, linkage 118 is pivotally coupled to arm 120 by pivot 122. The other end of arm 120 is fixedly connected to bar 84 by pivot 124. Accordingly, as bar 84 moves horizontally, so does arm 120 and, consequently, linkage 118 and upper walking foot 72.

Due to the limited space available in the machine, a slot 132 was cut through primary lower walking foot arm 82 through which arm 120 passes. The slot is long enough to allow arm 120 to slide horizontally therein because secondary lower walking foot bar 84, to which arm 120 is rigidly attached, can move at a different rate of speed and traverse a different distance than arm 82, as previously discussed.

The motion of presser foot 12 and needle 70 as well as the vertical component of the motion of upper walking foot 72 now will be described in detail in relation to FIGS. 5A, 5B, 7A and 7B. Needle assembly 71 comprises needle 70, which is attached to a first needle bar 140, which, in turn, is attached to a second needle bar 142 of larger diameter. The needle assembly 71 is driven up and down by reciprocating needle drive shaft 36 via arm 146 and linkages 148 and 150. Arm 146 is rigidly attached to the drive shaft 36. Connection points 152 and 154 are pivots. Needle drive shaft 36 further drives presser foot 12 (upwardly only, since presser foot 12 is permanently biased downwardly by assembly 10) via arm 38, and linkages 40 and 42. Arm 38 is fixedly mounted to shaft 36. Connecting points 144, 158 and 160 are pivoting points. Point 160 is coupled to presser foot rod 14, which in turn is rigidly coupled to presser foot 12 via presser foot arm 16. Needle drive shaft 36 also provides the vertical component of the elliptical motion of upper walking foot 72 via arm 138, linkages 40, 42 and 162 and arm 118. Connections 164 and 168 are pivots.

As discussed with respect to FIGS. 2 and 3, the height of the needle 70 has been increased by the addition of a trapezoidal wedge between the needle housing and the lower housing. Consequently, the throw of needle 70 had to be increased so that it still extends below the throat plate at the bottom of its throw to meet with the looper. The throw of needle 70 is increased in the present invention by increasing the rotation of needle drive shaft 36. The driving mechanism for causing needle drive shaft 36 to rotate is not shown in FIGS. 5A and 5B. Instead reference is made to FIGS. 7A and 7B which are side views of the needle drive shaft and selected related components. Needle drive shaft 36 itself is driven off of the main drive shaft 167 via connecting member 166. The bottom of connecting member 166 is attached to main drive shaft 167 via off-center pivot 170. The rotation of main drive shaft 167 drives member 166 up and down in primarily vertical motion. Needle drive shaft 36 is driven by the vertical motion of the upper end 172 of connecting member 166 via arm 174. Arm 174 is fixedly attached to needle drive shaft 36 and pivotally attached to connecting member 166 by pivoting connection 178. The rotation of needle drive shaft 36 has been increased in accordance with the present invention by replacing the original arm coupling connecting member 166 to drive shaft 36 with the much shorter arm 174. Accordingly, the same vertical travel of connecting member 166 produces a greater rotation of shaft 36. In order to accommodate the much closer proximity of the upper end 172 of connecting member 166 to needle drive shaft 36, the diameter of needle drive shaft 36 arm 174 was reduced in the vicinity of arm 174 so as to prevent connecting member 166 from striking shaft 36 at the top of its motion. The original circumference of shaft 36 is shown by dotted circular line 175 in FIGS. 7A and 7B. As can be seen in FIG. 7A, when connecting member 166 is in its uppermost position, the inner side surface **166*a* of connecting member 166 would have contacted the needle drive shaft of original circumference (circular line 175). Accordingly, drive shaft 36 was reduced in diameter in the vicinity of arm 174 and connecting member 166 to have the circumference illustrated by solid circular line 36*a***.

In FIGS. 7A and 7B, arm 146 and related components for driving the needle as well as arm 38 and related components for driving the presser foot are shown in phantom. It should be understood that these components are displaced perpendicular to the surface of the page from connecting member 166, and arm 174 and, in the Pegasus sewing machine, are actually separated from each other by a plate through which the needle drive shaft 36 passes (see FIG. **3*b*, for instance). It should also be understood that the diameter of drive shaft 36 has not been changed at the point where arms 146 and 38** are coupled to it.

Connecting member 166 was also lengthened to accommodate for the raising of needle drive shaft 36 by the insertion of wedge 50 between the two housings.

Returning to FIGS. 5A and 5B, presser foot 12 is permanently biased downwardly by spring assembly 10 as previously described. When needle drive shaft 36 rotates in the counter-clockwise direction, an upward force is exerted on presser foot rod 14 by needle drive shaft 36 via arm 38 and linkages 40 and 42. As can be seen in FIG. 5A, when upper walking foot 72 meets the upper surface **77*a* of the material 77, walking foot 72 presses down against the material until a predetermined force is exerted and the downward force of foot 72 is cancelled out by the upward force of throat plate 11 and material 77. At this point, the downward motion of foot 72 and thus arm 118 is halted. This, in turn, cause pivot point 164 to become almost stationary (linkage 162 actually can rotate very slightly when arm 118 is stationary). After this condition is reached, further clockwise motion of needle drive shaft 36 continues to force pivot point 158 on linkage 42 downward. However, since point 164 is essentially fixed in space, arm 42 rotates counterclockwise around point 164, thus causing pivot point 160 at the opposite end of linkage 42 to rise. Pivot point 160 is coupled to presser foot rod 14. Accordingly, presser foot rod 14 (and presser foot 12) are forced upwardly to disengage the material. Accordingly, presser foot 12 does not begin to travel upwardly off of top surface 77*a* of material 77 until walking foot 72 engages the material. The length of the various linkages and arms are selected such that the needle has also disengaged the material at this point so that the walking feet advance the material (to the left in FIGS. 5A and 5B**) only after the needle (and presser foot) have disengaged from the material.

Referring now to FIG. 5B, as the needle 70 plunges back into the material 77, a similar but opposite action occurs to that described above. When needle drive shaft 36 reaches the end of its counterclockwise reciprocation, it begins to rotate clockwise again urging needle 70 downwardly via arm 146 and linkages 148 and 150. This clockwise rotation of shaft 36 also causes linkage 42 to begin rotating clockwise around pivot point 164 urging presser foot 12 downwardly and eventually back into contact with the top surface **77*a* of the material. When the downward motion of presser foot 12 is halted by material 77, pivot point 160 at the end of arm 42 becomes fixed in space. Accordingly, at the point where the downward motion of presser foot 12 is halted by contact with the material, arm 42 continues to rotate in the clockwise direction, but it rotates about pivot point 160 instead of pivot point 164. Accordingly, pivot point 164 now begins to rise thus lifting upper walking foot 72 off of the material via linkage 162 and upper walking foot arm 118**.

As noted above, needle drive shaft 36 has been raised by the addition of the wedge shown in FIG. 2. Accordingly, the maximum clearance of not only the needle but also the presser foot and the upper walking foot have been increased. The maximum clearance of the presser foot 12 increases as linkages 40 and 162 increase in length. Essentially, increasing the lengths of linkages 40 and 162 produces an increase in the throw of the presser foot which translates at least partially into an increase in its upper travel limit. The lower travel limit of presser foot 12 is dictated by the material 77, the throat plate 11, or the lower cap nut 26 of spring assembly 10, whichever is highest.

Figure 8A:
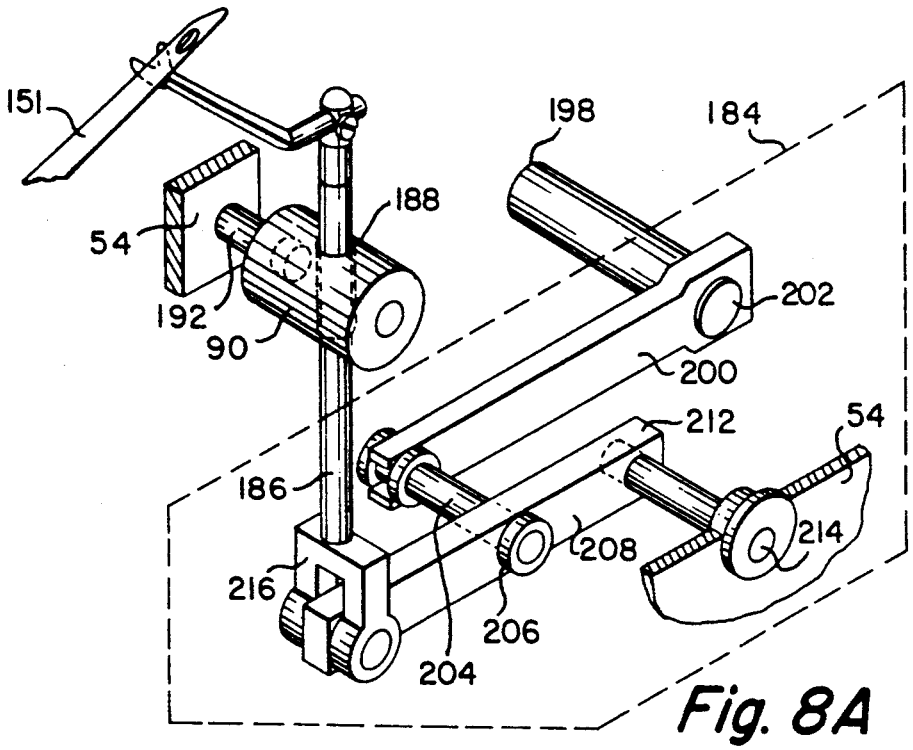
FIG. 8A is a cut away side view of the mechanism for operating the spreader of the sewing machine of the present invention showing the spreader in a first position.
Figure 8B:
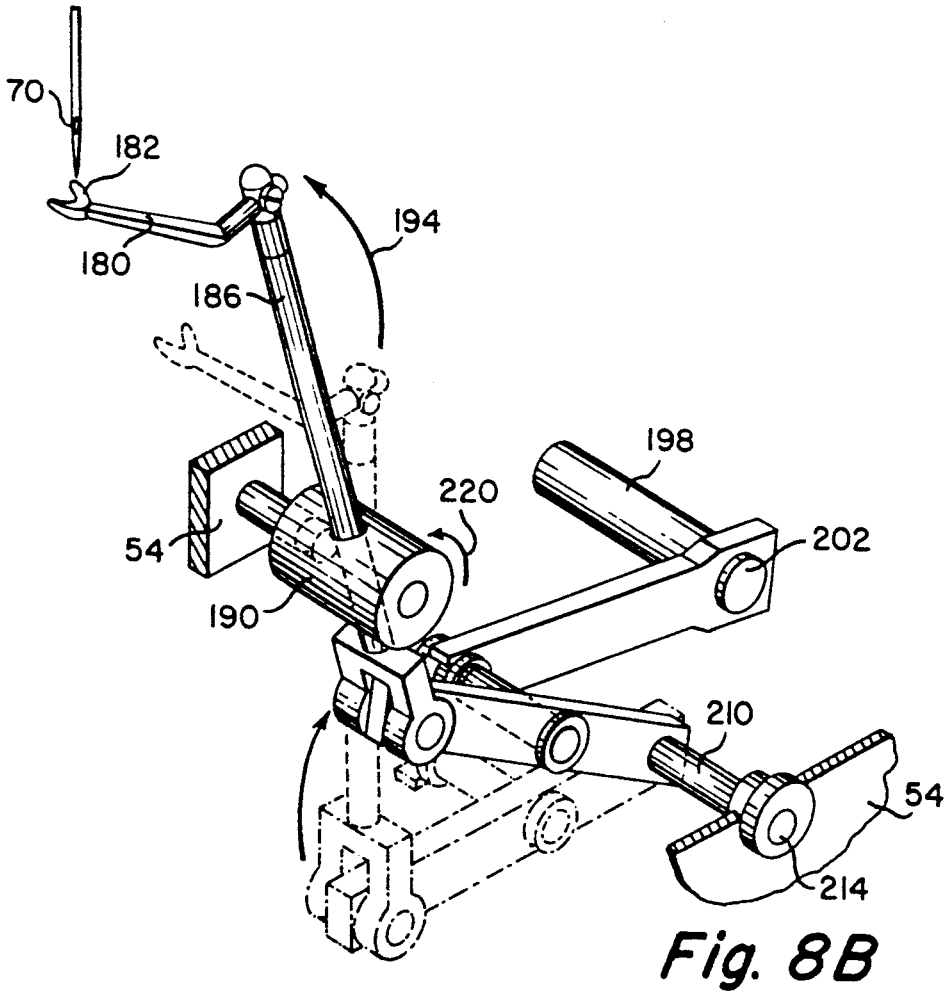
FIG. 8B is a cut away side view of the mechanism for operating the spreader of the sewing machine of the present invention showing the spreader in a second position.

FIGS. 8A and 8B illustrate improvements made to the spreader assembly in accordance with the present invention. As previously noted, spreader 180 comprises a fork 182 at its end which grabs thread off of a looper 151 when the spreader is near its lower travel limit (the position illustrated in FIG. A) and transports it around the edge of the fabric and over the fabric to meet the needle 70 near the top of the spreader's and the needle's travel limits (as illustrated in FIG. 8B). The spreader 180 is mounted on a spreader shaft 186 which slidingly passes through a hole 188 in guide 190. Guide 190 is attached to the lower housing by shaft 192 and can rotate on shaft 192. The motion of spreader fork 182 is essentially vertical until the very top of its throw where a slight arc is introduced as illustrated by arrow 194 in FIG. 8B so that the fork 182 will be adjacent the needle and the needle can engage the thread held in fork 182.

Spreader 180 is driven by reciprocating spreader drive shaft 198. In the base Pegasus sewing machine, drive shaft 198 is connected to the bottom of spreader shaft 186 by a single arm. In the present invention, that arm has been replaced by a multiple arm structure such as the double arm structure shown in box 184 in FIG. 8A. An arm 200, shorter than the original arm, is rigidly attached to drive shaft 198 at 202. The opposite end of arm 200 is attached to one end of a transverse connecting bar 204. The other end of connecting bar 204 fits through a hole 206 intermediate the ends of a second arm 208. Connecting bar 204 can rotate in hole 206. Shaft 210 fits through hole 212 in the end of second arm 208. Shaft 210 can rotate in hole 212. The other end of shaft 210 is fixed to the lower housing 54 by eccentric plug 214. Eccentric plug 214 can be rotated before being welded to housing 54 to adjust the exact position of shaft 210. The other end of arm 208 is coupled to the spreader shaft 186 by connecting member 216.

FIG. 8A shows the position of the spreader structure when shaft 198 is rotated to its furthermost counterclockwise position. As the shaft rotates clockwise from this position, arm 200 rotates clockwise raising connecting bar 204 in an upward arc. The raising of bar 204 causes arm 208 to rotate about shaft 210. As shown in FIG. 8B, the structure in box 184 causes arm 208 to rotate to a greater degree than arm 200. In fact, the multiple arm structure of the present invention causes spreader shaft 186 and spreader 180 to be lifted higher than it would be by a single arm extending between shaft 198 and spreader shaft 186.

As the spreader reaches the top of its motion, guide 190 is caused to rotate slightly in the direction of arrow 220, thus inducing a curve into the throw of the spreader 180 near its upper travel limit, as illustrated by arrow 194.

The replacement of the single arm with the two shorter arms 200 and 208 increases the throw of spreader 180. However, the lower travel limit of spreader 180 cannot be altered because spreader fork 182 must still meet the looper in the same position since the looper has not been moved. Although several methods of adjusting the lower travel limit of spreader 180 are available, in a preferred embodiment, the relative positioning and lengths of arms 200 and 208 were selected such that the increase in throw produced translated into an increase in both the upper and lower travel limit of the spreader shaft 186. Then, spreader shaft 186 was lengthened so that, overall, the lower travel limit of spreader 180 was returned to the original point even though the lower limit of spreader shaft 186 was lowered.

Figure 9A:
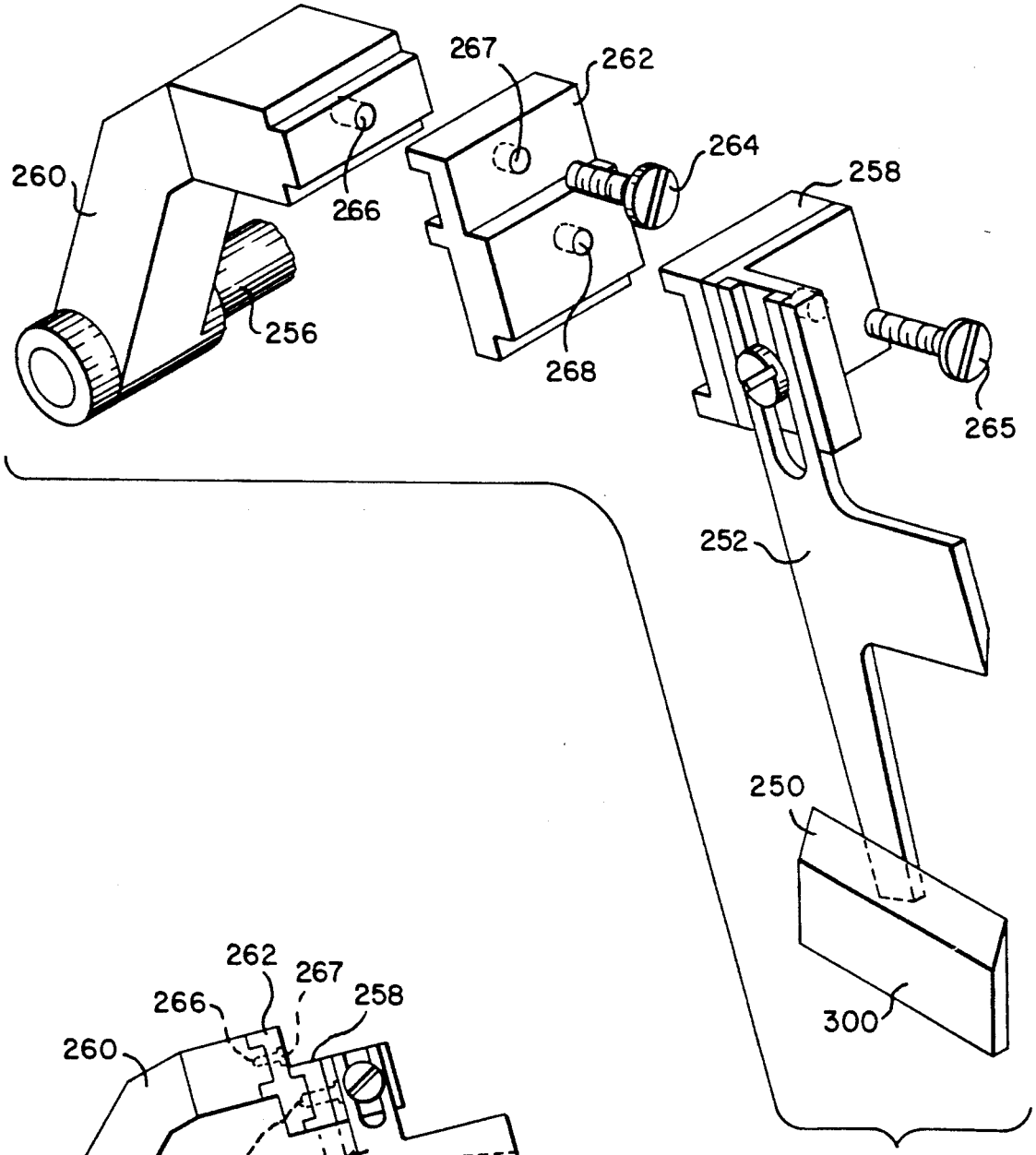
FIG. 9A is an exploded perspective view of the edging knife assembly of the present invention.
Figure 9B:
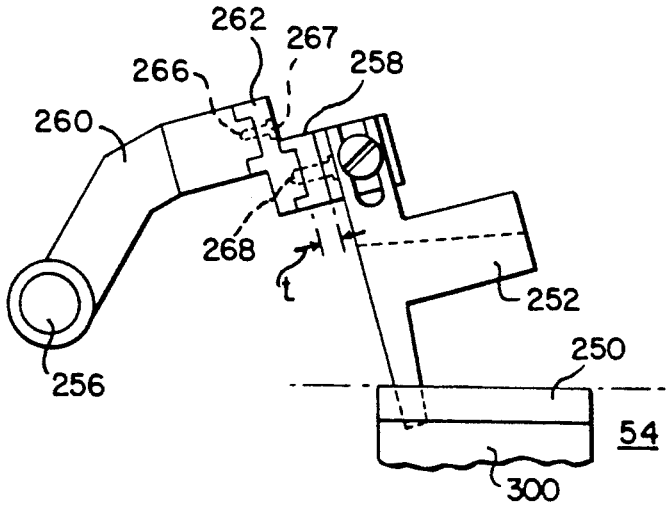
FIG. 9B is a side view of the knife assembly of the present invention.

FIGS. 9A and 9B illustrate improvements made to the edging knife assembly of the Pegasus sewing machine in order to accommodate other improvements made to the machine. The Pegasus sewing machine comprises a knife assembly for cutting the material and creating the edge around which the overcast stitch is made. This assembly comprises a lower knife 250 fixedly attached to the lower housing 54. An upper knife 252 is mounted on a knife drive shaft 256 via a knife holder 258 and an arm 260. The knife drive shaft 256 reciprocates causing the upper knife 252 to meet with the lower knife 250 during the lower portion of its travel, similarly to a pair of scissors, and to rise above the lower knife during the upper portion of its travel.

The lengthened spreader shaft discussed above with respect to FIGS. 8A and 8B, however, interfered with knife arm 260. In order to provide the necessary clearance between knife arm 260 and the spreader shaft, the knife arm 260 was loosened from shaft 256, rotated upwardly (counterclockwise in FIG. 9B) and then reattached to shaft 256. However, after this modification, the upper knife 252 was too high and would no longer properly mate with the lower knife during the lower portion of its travel. Accordingly, a spacer 262 was added between the end of the arm 260 and the knife holder 258. The spacer 262 is shaped to lower the knife relative to the arm and move it slightly rearwardly (towards the right in FIG. 9B) by the thickness, t, of the spacer.

In the original Pegasus sewing machine, the knife holder 258 is screwed into a hole 266 in the end of arm 260 by screw 264, passing through hole 267 in the spacer 262. With the addition of the knife spacer 262, the spacer 262 is now screwed into the threaded hole 266 in the knife arm by screw 264 and the knife holder 258 is screwed into a second threaded hole 268 in the spacer by screw 265 as shown in FIG. 9B.

In order to accommodate the rearward displacement of the upper knife 252, the lower knife holder was also replaced with the knife holder 300 which moved the lower knife rearwardly by the same displacement as the upper knife.

Having thus described a few particular embodiments of the invention, various alterations, modifications and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A walking foot assembly for a sewing machine for advancing material between stitches, comprising:

first and second lower walking feet mounted on first and second lower walking foot bars, respectively, an upper walking foot positioned directly above said second lower walking foot and mounted on an upper walking foot bar, means for driving said first lower walking foot bar and foot to travel through an elliptical path at a first speed, means for driving said second lower walking foot to travel through an elliptical path at a second speed different from said first speed, a member directly connecting said upper walking foot bar to said second lower walking foot bar such that the motion of said upper walking foot bar and foot is responsive to the motion of said second lower walking foot bar.

2. An apparatus as set forth in claim 1 wherein said connecting member comprises an arm fixedly attached to said second lower walking foot driving means, said arm passing through a slot in said first lower walking foot driving means, whereby said arm can slide freely in said slot when said speed of said first lower walking foot driving means is different than the speed of said second lower walking foot and said upper walking foot.

3. An apparatus as set forth in claim 1 wherein said means for driving one of said lower walking feet is adjustable so that one of said first and second speeds can be changed relative to the other.

4. An apparatus as set forth in claim 1 wherein said means for driving said first lower walking foot comprises a reciprocating shaft and a first arm assembly coupling said reciprocating shaft to said first lower walking foot and wherein said means for driving said second lower walking foot comprises said reciprocating shaft and a second arm assembly coupling said second lower walking foot to said reciprocating shaft.

5. An apparatus as set forth in claim 4 wherein said second arm assembly comprises first and second arm members joined at a pivot and wherein the location of said pivot is adjustable along a length of said first arm member.

6. An apparatus as set forth in claim 5 wherein said pivot comprises a pin fixed to said second arm member and wherein said first arm member has a plurality of holes through which said pin may pass, the speed of said second lower walking foot relative to said first lower walking foot being determined by a location of the hole within which said pin is positioned.

7. A walking foot assembly for a sewing machine for advancing material between stitches, comprising:

first and second lower walking foot, an upper walking foot positioned directly above said second lower walking foot, means for driving said first lower walking foot to travel through an elliptical path at a specified speed, means for driving said second lower walking foot to travel through an elliptical path at a speed different than the speed of said first lower walking foot; and an arm fixedly attached to said lower walking foot driving means, said arm passing through a slot in said first lower walking foot driving means, whereby said arm can slide freely in said slot when said speed of said first lower walking foot driving means is different than the speed of said second lower walking foot driving means.

* * * * *